United States Patent [19]

Cummings et al.

[11] 4,266,365

[45] May 12, 1981

[54] RINGING TOY TELEPHONE

[75] Inventors: Charles A. Cummings; Gerald Rodmaker, both of Cincinnati, Ohio

[73] Assignee: C.P.G. Products Corp., New York, N.Y.

[21] Appl. No.: 76,316

[22] Filed: Sep. 17, 1979

[51] Int. Cl.[3] ..... A63H 33/30

[52] U.S. Cl. ..... 46/33; 46/191; 46/44

[58] Field of Search ..... 46/33, 175 R, 175 AR, 46/191, 192, 174, 232, 44

[56] References Cited

U.S. PATENT DOCUMENTS

| | | | |
|---|---|---|---|
| 2,496,666 | 2/1950 | Heyman | 46/33 UX |
| 3,422,566 | 1/1969 | Wolf | 46/232 X |
| 3,548,536 | 12/1970 | Glass et al. | 46/33 |
| 4,103,452 | 8/1978 | Wood | 46/33 |
| 4,104,821 | 8/1978 | Nakajima | 46/33 |

*Primary Examiner*—Gene Mancene

*Attorney, Agent, or Firm*—Bacon & Thomas

[57] ABSTRACT

A toy telephone has a handpiece and a cradle for the handpiece. The cradle is spring urged upwardly at a controlled rate when the handpiece is lifted. A motor driven phonograph reproduces recorded sound only when the cradle is in its upper position. When the handpiece is placed on the cradle, it moves to its lower position and in doing so causes the phonograph motor to rotate intermittently in a reverse direction. Upon reverse rotation of the motor a clapper on the motor shaft moves outwardly to ring a bell located near the motor. Movement of the cradle actuates switches to control the direction of motor rotation.

11 Claims, 8 Drawing Figures

FIG. 1
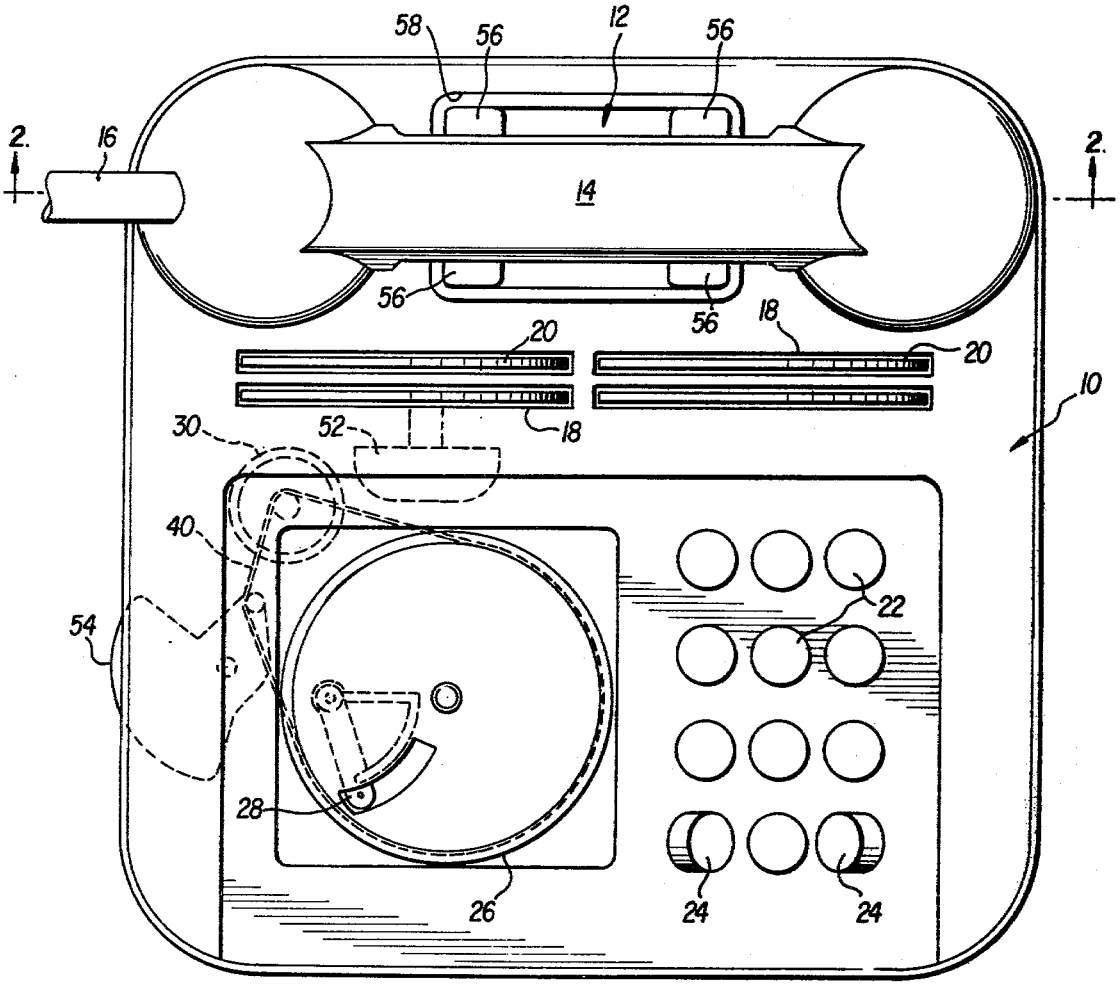
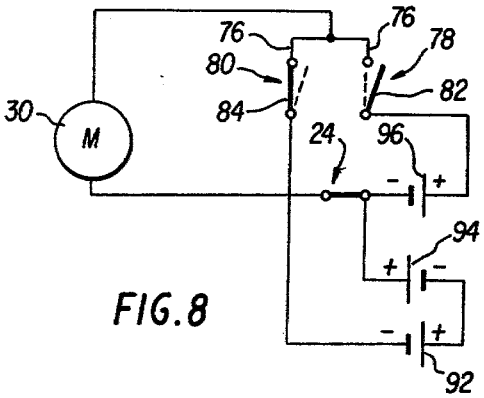
FIG. 8

RINGING TOY TELEPHONE

BACKGROUND OF THE INVENTION

This invention is in the field of toy telephones, particularly toy telephones having bell-ringing means and sound reproducing phonographs therein.

Toy telephones having bell-ringing means are known, see, for example, the patent to Wolf, U.S. Pat. No. 3,422,566, and the patent to Breslow et al, U.S. Pat. No. 3,757,463. In the Wolf patent, the toy telephone is placed on a table-like support having a magnet below its upper surface. When the telephone is placed over the magnet, the magnet induces closing of a circuit to effect ringing of the telephone bell to simulate an incoming telephone call. When the toy instrument is placed on some other area of the support, no bell ringing takes place. In the Breslow patent, a bellows device within the toy telephone can be expanded from a remote location through a tubular line to ring a bell and thus simulate an incoming telephone call.

Neither of the above patents, however, disclose a toy telephone wherein mere manipulation of the parts of the instrument itself will effect ringing a bell to simulate an incoming call.

SUMMARY OF THE INVENTION

The present invention is directed to a toy telephone having a bell therein which rings only when a driving motor for the phonograph rotates in a reverse direction. A handpiece may be lifted from its cradle, thus freeing the cradle to rise under the influence of a spring and a dashpot arrangement controls the rate at which the cradle moves. When the handpiece is replaced on the cradle and the cradle lowers, it intermittently closes contacts to effect reverse rotation of the phonograph motor and a weight carried by the motor shaft flies outwardly to impinge and ring a bell. When the motor rotates in the forward or sound-reproducing direction, the weight is held inwardly and bell ringing is prevented. A further switching arrangement controlled by the movable cradle effects opening and closing of a phonograph switch to cause the motor to rotate in a forward or sound reproducing direction, but that switch is closed only when the cradle is in its uppermost position.

BRIEF DESCRIPTION OF THE DRAWINGS

FIG. 1 is a top plan view of a toy telephone incorporating the present invention.

FIG. 8 is a schematic wiring diagram showing how the switches, motor and batteries are arranged in controlling circuit.

DESCRIPTION OF THE PREFERRED EMBODIMENT

Figure 2:
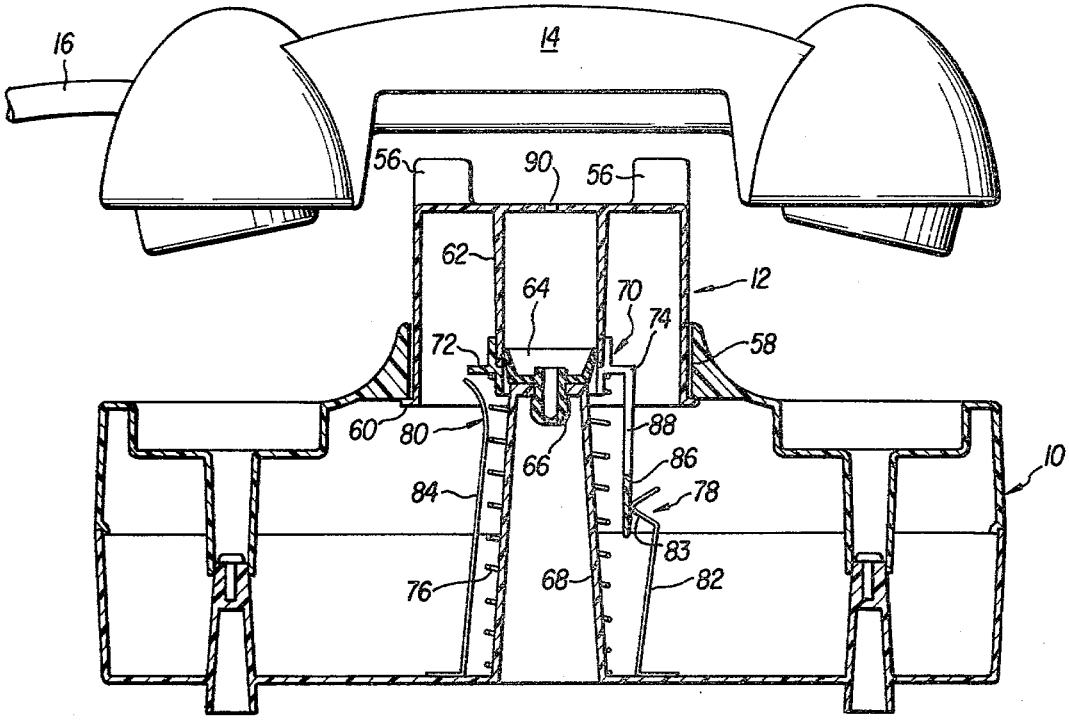
FIG. 2 is a vertical sectional view taken generally along the line 2—2 of FIG. 1, showing the handpiece in elevation and lifted with the cradle in its upper position.

As seen in FIG. 1, the toy telephone of the present invention comprises base member 10, having a vertically movable cradle 12 thereon for a handpiece 14. The handpiece simulates the conventional handpiece of a telephone having a receiver and simulated transmitter at the ends thereof. Extending from the handpiece 14 is a hollow tube 16, one end of which is at the receiver end of the handpiece and the other end of which is arranged to receive sounds from a phonograph speaker within the base member 10. Toy telephones of this type are known wherein sounds from a toy phonograph in the instrument are transmitted through a tube to a handpiece.

The base member 10 is further provided with pockets 18 to receive records 20 for storage.

The base member 10 is also provided with simulated push buttons 22 and buttons 24 constituting an on/off switch, to be described. Preferably the push buttons 24 are at opposite ends of a rocking lever which, when rocked, operates a switch to either "on" or "off" position.

A rotatable drum 26, mounted on a post 27, carries a tone arm 28, which rotates beneath a record when the latter is placed on a record support, and thereby reproduces sounds recorded on the record disc. The toy phonograph of the present invention may employ the rotating tone arm type of structure or it may be designed to rotate a record disc against a stationary stylus, but in any event it will include a rotary drum or similar element 26.

Figure 6:
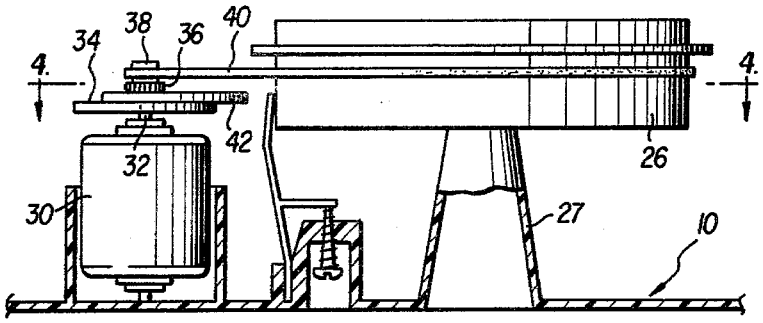
FIG. 6 is a fragmentary sectional view taken generally along the line 6—6 of FIG. 4.
Figure 7:
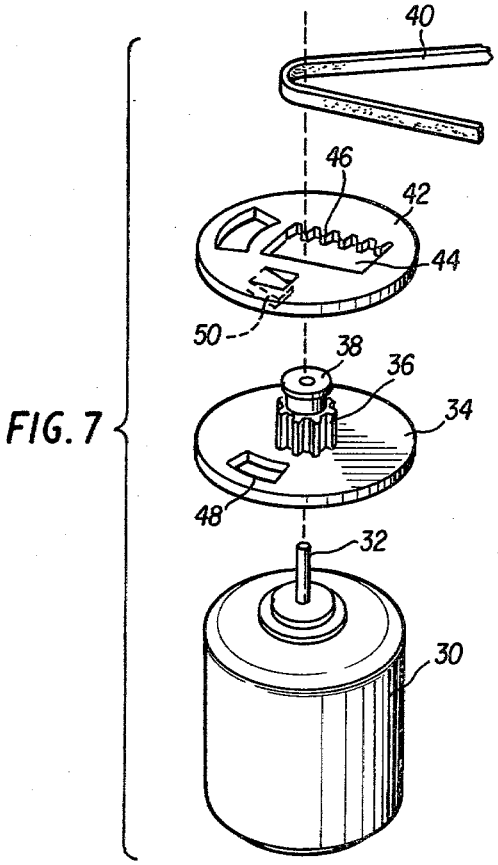
FIG. 7 is an exploded view of the motor and bell ringing clapper to be described.

The drum 26 (see FIG. 6) is driven in rotation by an electric motor 30 mounted in a receptacle molded as part of the base member 10. At this point it is to be noted that the base member 10 is preferably molded of a suitable plastic material which also constitutes an electrical insulator.

The motor 30 is provided with a driving shaft 32 on which a flywheel 34 is fixed. Extending upwardly from the flywheel 34 is a pinion gear 36 also fixed to shaft 32 and a pulley portion 38 for driving belt 40 which extends around the drum 26 previously referred to. Thus, when the motor 30 is rotating it will drive the drum 26 in rotation.

Resting upon the flywheel 34 is a clapper disc 42 having a central diametral slot 44 therein and which slot is provided along one of its edges with gear teeth 46. The teeth 46 are in mesh with the teeth of pinion gear 36. The flywheel 34 is also provided with a slot 48 therein receiving a projection 50 on the clapper disc 42, which projection limits the radial and rotational movement of clapper disc 42 relative to the flywheel 34 and gear 36.

Figure 4:
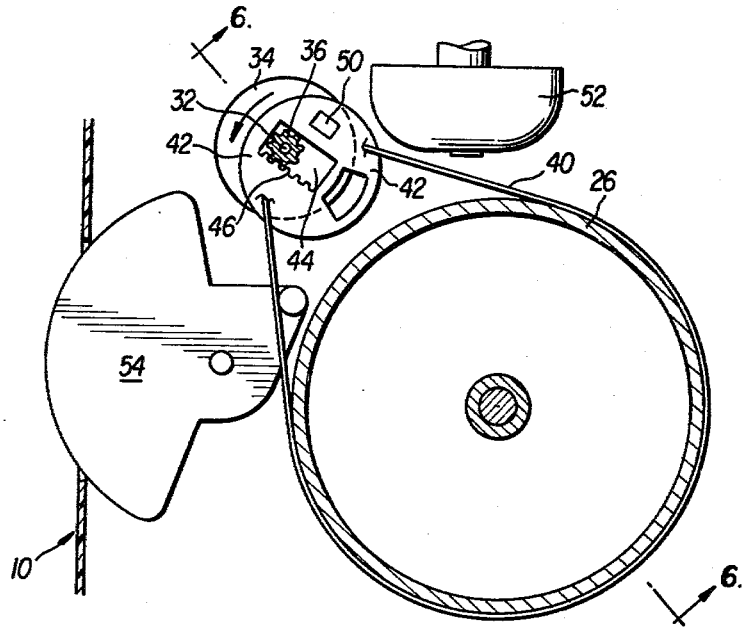
FIG. 4 is a fragmentary horizontal sectional view of a portion of the toy telephone of FIG. 1, taken generally along the line 4—4 of FIG. 6 and showing the parts in a bell-ringing mode.
Figure 5:
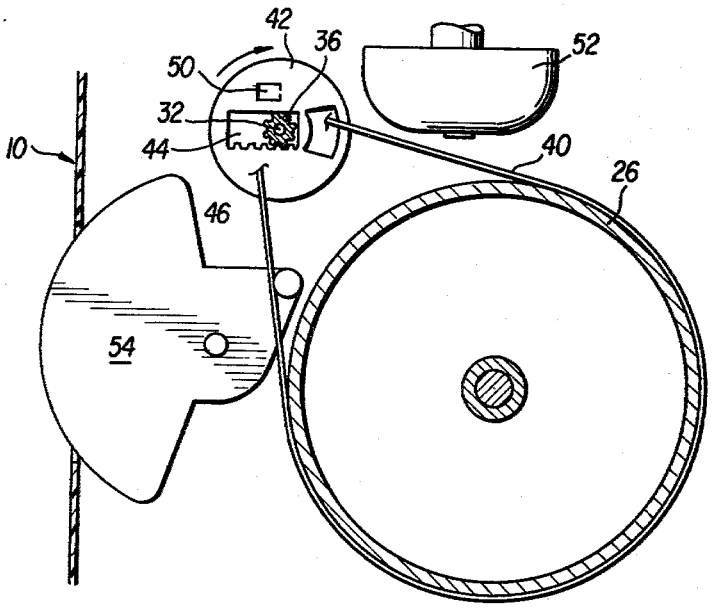
FIG. 5 is a view similar to FIG. 4, but showing the relationship of the parts when the motor is rotating in a forward or sound reproducing direction.

Arranged adjacent the motor 30 and supported by the base member 10 is a bell 52 (see also FIGS. 4 and 5). Referring particularly now to FIGS. 4 and 5, FIG. 5 shows the parts when the motor is rotating in a clockwise direction and in a direction to effect reproduction of sounds from the record disc 20 when in the record playing support. It will be appreciated that clockwise rotation of the pinion gear 36 will apply an inward force to the clapper disc 42 urging the same radially inwardly to its limiting position as shown in FIG. 5. In this position, inward movement of the clapper disc is at least partially limited by the projection 50 engaging an end of the slot 48, and the disc is at this time concentric to the flywheel disc 34. When the motor 30 rotates in a reverse or counterclockwise direction, as seen in FIG. 4, the pinion gear 36 applies a force to the clapper disc 42, tending to urge the same radially outwardly of the motor shaft. It is to be remembered that when the motor starts to rotate, the disc 42 tends to lag behind due to its inertia, and thus the torque applied thereto by the gear 36 urges the same outwardly. In its outermost position, the clapper disc 42 projects sufficiently far from the axis of motor shaft 32, so that its outer edge portion impinges the bell 52 at each rotation. Thus, when the motor 30 is caused to rotate in reverse, or counterclockwise direction, it causes the bell to ring. A speed control member 54 is provided whereby the user can compensate for battery wear. During the bell ringing cycle, the tone arm merely rotates in a reverse direction and stays in the starting groove of the disc record if such a record is in position. Thus, no sounds would be reproduced from the record during such reverse rotation.

Figure 3:
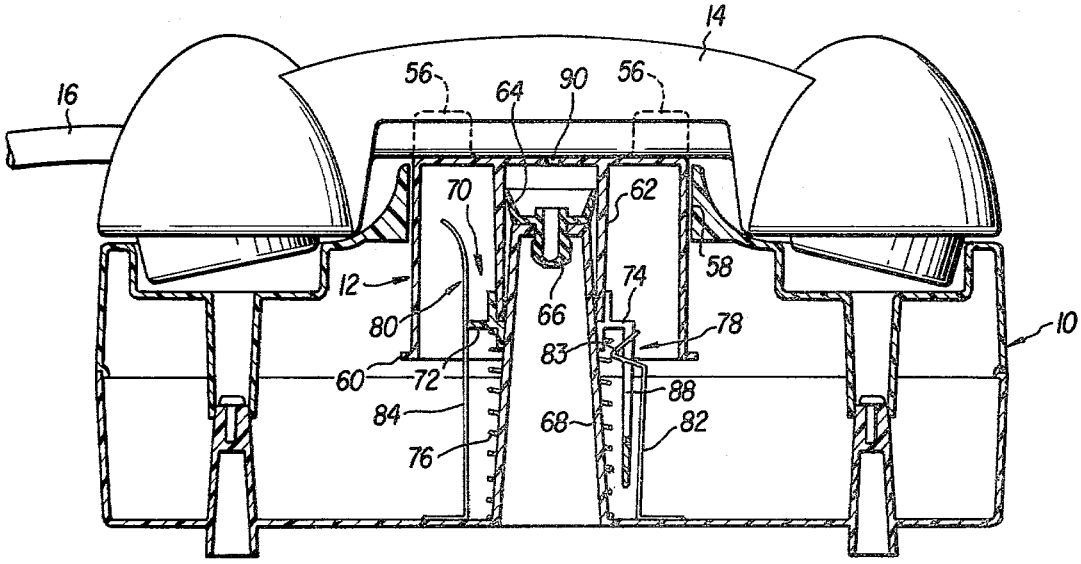
FIG. 3 is a view similar to FIG. 2 showing the cradle in its lower position, with the weight of the handpiece thereon.

Referring to FIGS. 2 and 3, the cradle 12 is shown as having pairs of upstanding lugs 56 to hold the handpiece 14 thereon, in simulation of a conventional telephone. The cradle 12 projects upwardly through an opening 58 in the upper surface of base member 10 and is provided further with a lowermost flange 60 to limit upward movement thereof. The cradle 12 is downwardly hollow and its interior is formed to define a cylinder 62 in which a piston element 64 is slidable. The element 64 is preferably of resilient material molded to generally cup shape, and having a projection 66 by which it is retained at the upper end of an insulating post 68 constituting an integral portion of the base member 10. A cap 70 is fixed to the lower end of the cylinder 62 and is formed with a circumferential flange 72 and a depending bracket member 74. A helical coil spring 76 bears against the bottom of the frame member 10 and at its upper end bears against the flange 72 to thus urge the cradle 12 upwardly to its uppermost position. It is to be noted at this point that the spring 76 is sufficiently strong to lift the cradle to its upward position when the handpiece 14 is removed, but that the handpiece is sufficiently heavy to overcome the spring 76 when the handpiece is on the cradle 12 and to cause the same to move to its lower position shown in FIG. 3. As will be described, the spring 76 constitutes part of the motor control circuit along with switches 78 and 80. The first switch 78 is in the form of a first leaf spring 82 secured at one of its ends to the base member 10, but with its upper end bent upwardly to define a contact nose 83 for a purpose to be described. The second switch 80 is defined by a second leaf spring 84 also secured at its lower end to the base member 10 and curved at its upper end as shown in the drawings. The switch 78 will be referred to herein as a first switch and switch 80 as a second switch.

With the parts in the position shown in FIG. 2, it is to be noted that the leaf spring 84 is flexed inwardly to make contact with the spring 76, thus completing a circuit to drive the motor 30 in a forward or sound reproducing direction, as will be further described. At this time, the leaf spring 82 is flexed outwardly and first switch 78 is held open by the solid lower portion 86 of bracket member 74. Assuming that the switch buttons 24 have been manipulated to close the on/off switch, with the parts shown in the relative positions of FIG. 2, the phonograph will reproduce sounds recorded on a record disc 20 and which sounds can be heard by the child holding the handpiece 14.

When the parts are in the position shown in FIG. 3, the flange 72 cams or flexes leaf spring 84 outwardly, out of contact with spring 76 and thus the second switch is in its open position. At this time, the upper end of leaf spring 82 is permitted to move inwardly toward the spring 76 through a slot 88 in bracket 74. However, with the cradle 12 in its lowermost position as shown, the contact nose 83 of the leaf spring 82 does not touch the spring 76, it is positioned between turns thereof.

As also shown in FIGS. 2 and 3, the upper surface of the cradle 12, which defines the closed end wall of the cylinder 62, is provided with a small opening 90 constituting a speed control means. If the handpiece 14 were lifted from the cradle when the parts are in the position of FIG. 3, the spring 76 would urge the cradle upwardly, but to do so it would be necessary to draw air into the cylinder 62. The restricted orifice 90 limits the rate at which air can be drawn inwardly and thus controls the rate at which the cradle rises to its upper position. In like manner, the orifice 90 controls the rate at which the cradle will be lowered when the handpiece is placed thereon.

Assuming the parts to be in the position of FIG. 2, when the handpiece is placed on the cradle, the cradle starts to lower, and in so doing the spring 76 is compressed or shortened, bringing its successive turns closer together. During the movement of the cradle from its upper to its lower position, preferably about three conolutions of the spring 76 will pass the position of the contact nose of leaf spring 82 and make contact therewith thus intermittently closing the first switch, which causes intermittent reverse rotation of the motor 30.

Referring now to FIG. 8, there is shown therein a schematic wiring diagram of the electrical circuits controlling the motor 30. As shown, two batteries 92 and 94 are arranged in series, and are effective to rotate the motor 30 in a forward or record playing direction. A single battery 95 is arranged in an auxiliary circuit to effect reverse rotation of the motor 30 by virtue of its polarity. In FIG. 8, numeral 24 indicates the off/on switch operable by manipulating buttons 24 previously described. First and second switches 78 and 80 are schematically shown in FIG. 8 wherein switch 80 is shown in the closed position, and switch 78 is shown in its open position, thus corresponding to the position of the parts shown in FIG. 2 of the drawings wherein the record is being played and sounds are reproduced. In this mode of operation, it is to be noted that the positive end of the series of batteries 92, 94 is connected to the lower terminal of motor 30. When the parts are in position such that the cradle 12 is moving downwardly and effecting intermittent closure of switch 78, the switch 80 is held open and the switch 78 is intermittently closed, thus applying positive voltage from the battery 95 to the upper terminal of motor 30. In the two modes, it is to be noted that the polarity applied to the motor 30 is reversed and thus the motor is caused to rotate in different directions, depending upon which switch, 78 or 80, is closed.

From the foregoing descriptions, it will be apparent that a child may select any one of records 20 and place it in his record player whereupon by closing the on/off switch and lifting the handpiece, he may listent to the sounds reproduced from the record. The child may also request a return call whereupon he places the handpiece 14 on the cradle 12 and the same is lowered from the position of FIG. 2 to the position of FIG. 3, and, in the manner described, causes the bell 52 to ring intermittently thus indicating that someone is calling. He may then lift the handpiece 14 and listen to a further sound reproduction. Preferably, the records 20 and the phonograph system are such that each record contains a plurality of recordings and which are randomly selected for play. Such devices are known and will not be further described here.

While a single specific embodiment of the invention has been shown and described, the same is merely illustrative of the principles involved and other forms may be employed within the scope of the appended claims. For example, ringing of the bell may be accomplished by a second motor rather than by reversing a single motor, the important feature being the time delay between replacing the handpiece on its cradle and the ringing of the bell. Also, it is not necessary that the spring 76 itself be an electrical contact. It is within the scope of the invention to provide other switch contact means movable with the cradle 12.

We claim:

1. A toy telephone comprising:
a base member having a bell thereon;
a handpiece supporting cradle on said base, mounted thereon for vertical movement;
biasing means urging said cradle to move upwardly;
a movable handpiece of sufficient weight to move said cradle downwardly against said biasing means when placed thereon;
bell ringing means response to downward movement of said cradle to effect ringing of said bell; and
delay means for slowing downward movement of said cradle and thereby delaying ringing of said bell to a time substantially subsequent to placing said handpiece on said cradle.

2. A toy telephone as defined in claim 1 wherein said bell ringing means includes a control switch operable by movement of said cradle on said base.

3. A toy telephone as defined in claim 1 wherein said delay means comprises damping means for limiting the rate of movement of said cradle.

4. A toy telephone as defined in claim 3 wherein said damping means comprises a dashpot having a piston and cylinder, said piston and cylinder being respectively mounted on said cradle and base member and defining an expansible chamber.

5. A toy telephone as defined in claim 2 wherein said biasing means is a helical compression spring;
said control switch comprising a leaf spring carried by said base and having an end engageable with successive turns of said helical spring to intermittently close said control switch as said helical spring is being compressed; and
a projection carried by said cradle for flexing said leaf spring away from said helical spring only when said cradle is in its upper position.

6. A toy telephone as defined in claim 1 wherein said base member has a rotatable member thereon and a motor having a shaft drivingly connected to said rotatable member;
said bell being adjacent said motor shaft;
said bell ringing means including a radially movable clapper member carried by said motor shaft;
clapper means responsive to rotation of said shaft in one direction to retain said clapper in its radially innermost position and responsive to rotation of said motor shaft in the other direction to permit said clapper to move outwardly sufficiently to impact and ring said bell; and
means for selectively controlling the direction of rotation of said motor.

7. A toy telephone as defined in claim 6 wherein said rotatable member is part of a record player for reproducing recorded sounds and arranged to reproduce recorded sounds only when said motor rotates in said one direction.

8. A toy telephone as defined in claim 6 wherein said clapper control means comprises:
a clapper disc movably mounted on said motor shaft;
means limiting radial and rotational movement of said clapper disc relative to said motor shaft; and
interconnected means on said motor shaft and clapper disc for resisting the inertia of said disc when said motor starts to turn in said one direction and thereby to hold said disc in its radially inner position and to assist the inertia of said disc when the motor starts to turn in said other direction and thereby cause said disc to move outwardly for ringing said bell.

9. A toy telephone as defined in claim 8 including a flywheel disc on said motor shaft, said clapper disc resting on said flywheel disc;
said interconnected means comprising a diametral slot in said clapper disc embracing said motor shaft and having gear teeth along one edge of said slot and a pinion gear on said shaft, meshing with said gear teeth; said limiting means being a chordal slot in said flywheel disc and a projection on said clapper disc projecting into said chordal slot.

10. A toy telephone as defined in claim 7 wherein said bell ringing means includes a first control switch operable by downward movement of said cradle to cause said shaft to rotate in said other direction and a second control switch operable by said cradle, when in its upper position, to cause said shaft to rotate in said one direction.

11. A toy telephone as defined in claim 3 wherein said damping means comprises a dashpot having an expansible chamber mounted between cradle and base members; and a restricted orifice from said chamber to the atmosphere.

* * * * *